US012429254B2

(12) United States Patent
Scuderi

(10) Patent No.: US 12,429,254 B2
(45) Date of Patent: Sep. 30, 2025

(54) ABSORPTION CHILLER SYSTEM WITH A TRANSPORT MEMBRANE HEAT EXCHANGER

(71) Applicant: Scuderi Group, Inc., West Springfield, MA (US)

(72) Inventor: Salvatore C. Scuderi, Westfield, MA (US)

(73) Assignee: SCUDERI GROUP, INC., West Springfield, MA (US)

( * ) Notice: Subject to any disclaimer, the term of this patent is extended or adjusted under 35 U.S.C. 154(b) by 0 days.

(21) Appl. No.: 18/797,065

(22) Filed: Aug. 7, 2024

(65) Prior Publication Data

US 2025/0035345 A1 Jan. 30, 2025

Related U.S. Application Data

(63) Continuation of application No. 18/312,930, filed on May 5, 2023, now abandoned.
(Continued)

(51) Int. Cl.
*F25B 15/06* (2006.01)
*F01N 3/02* (2006.01)
(Continued)

(52) U.S. Cl.
CPC ..... *F25B 15/06* (2013.01); *F01N 3/0205* (2013.01); *F01N 3/043* (2013.01); *F01P 3/22* (2013.01)

(58) Field of Classification Search
None
See application file for complete search history.

(56) References Cited

U.S. PATENT DOCUMENTS 4,672,821 A 6/1987 Furutera
11,286,832 B1 3/2022 Scuderi
(Continued)

FOREIGN PATENT DOCUMENTS

CN 105771674 A 7/2016
EP 1074794 A1 2/2001
(Continued)

OTHER PUBLICATIONS

CN105771674A English Machine Translation (Year: 2016).*
(Continued)

*Primary Examiner* — Jenna M Maroney
(74) *Attorney, Agent, or Firm* — HESLIN ROTHENBERG FARLEY & MESITI P.C.

(57) ABSTRACT

An absorption chiller system includes a generator section, a condenser section, an evaporator section and an absorber section all in fluid communication with each other and which operate to circulate a refrigerant therethrough. The evaporator section includes a transport membrane heat exchanger. The transport membrane heat exchanger includes a first and a second flow path. The first flow path is operable to flow the refrigerant therethrough under a vacuum pressure that is low enough to vaporize the refrigerant within the first flow path. The second flow path is operable to pass a fluid having water therethrough. Both water and heat are transferred from the fluid in the second flow path to the refrigerant in the first flow path through a membrane-based material of the transport membrane heat exchanger, such that the fluid passing through the second flow path has at least a portion of its water removed and is cooled.

9 Claims, 7 Drawing Sheets

Related U.S. Application Data

(60) Provisional application No. 63/371,546, filed on Aug. 16, 2022.

(51) Int. Cl.
*F01N 3/04* (2006.01)
*F01P 3/22* (2006.01)

(56) References Cited

U.S. PATENT DOCUMENTS

| | | | | |
|---|---|---|---|---|
| 11,339,712 | B1 | 5/2022 | Scuderi | |
| 11,346,256 | B1 | 5/2022 | Scuderi | |
| 11,415,052 | B1 | 8/2022 | Scuderi | |
| 11,719,136 | B2 | 8/2023 | Scuderi | |
| 2016/0069329 | A1 | 3/2016 | Brodetsky | |
| 2016/0289143 | A1 | 10/2016 | Duggal | |
| 2018/0334927 | A1 | 11/2018 | Löytty | |
| 2019/0040792 | A1 | 2/2019 | Eramaa | |
| 2019/0120131 | A1 | 4/2019 | Scuderi | |
| 2023/0069597 | A1 | 3/2023 | Wu | |
| 2023/0130504 | A1 | 4/2023 | Voice | |
| 2023/0366567 | A1 | 11/2023 | Fong | |
| 2025/0035345 | A1 * | 1/2025 | Scuderi | F25B 15/06 |
| 2025/0050270 | A1 * | 2/2025 | Scuderi | B01D 53/265 |

FOREIGN PATENT DOCUMENTS

| | | | | |
|---|---|---|---|---|
| WO | 2020089186 | A1 | 5/2020 | |
| WO | WO-2024039992 | A2 * | 2/2024 | F01N 3/0205 |

OTHER PUBLICATIONS

The Inverted Brayton Cycle for Waste-Heat Utilization—Wilson, ASME 1973 International Gas Turbine Conference and Products Show, doi: 10.1115/73-GT-90, (1973) (Year: 1973).

EP-107 4794-A2 English Machine Translation (Year: 2001).

* cited by examiner

ABSORPTION CHILLER SYSTEM WITH A TRANSPORT MEMBRANE HEAT EXCHANGER

CROSS REFERENCE TO RELATED APPLICATIONS

This application is a Continuation of U.S. patent application Ser. No. 18/312,930, filed May 5, 2023, entitled, "ABSORPTION CHILLER SYSTEM WITH A TRANSPORT MEMBRANE HEAT EXCHANGER," which claims priority to U.S. provisional application 63/371,546, filed Aug. 16, 2022, entitled, "ABSORPTION CHILLER SYSTEM WITH A TRANSPORT MEMBRANE HEAT EXCHANGER," the contents of which are incorporated herein by reference in their entirety.

TECHNICAL FIELD

The present disclosure relates to absorption chiller systems methods of using the same. More specifically, the disclosure relates to absorption chiller systems, which have evaporators that include a transport membrane heat exchanger.

BACKGROUND

Cooling and drying a fluid which contains water (a hydrated fluid), without utilizing an undue amount of energy is a challenging problem in several industrial applications. Examples of such industrial applications would be cooling and drying air in an air conditioning system or cooling and drying exhaust gas from an internal combustion engine in a bottoming cycle power system.

In the case of exhaust gas from an internal combustion engine, one of the most challenging aspects of today's energy technologies is to effectively convert waste heat from the exhaust gas of a combustion process into useable power. Systems of converting waste heat into useful forms of energy are commonly referred to as bottoming cycle power systems, or other combustion systems such as gas or oil fired furnaces.

Bottoming cycle power systems often include an expansion turbine (or turbo-expander) connected to a compression turbine (or turbo-compressor) via a common crankshaft.

The exhaust gas flows through the turbo-expander where it may exit the turbo-expander at below atmospheric pressures (or vacuum pressures). The vacuum pressures are caused by the turbo-compressor, which pumps the exhaust gas back to atmospheric pressures as the exhaust gas exits the bottoming cycle power system. The amount of usable energy (or net-work) recovered from a bottoming cycle power system is the energy produced by the turbo-expander minus the energy consumed by the turbo-compressor. Therefore, the less work needed by the turbo-compressor to compress the expanded volume of exhaust gas, the greater the net-work produced from the bottoming cycle power system.

Various prior art cooling systems may be utilized to reduce the specific volume of exhaust gas prior to entering the turbo-compressor and, therefore, reduce the amount of work required by the turbo-compressor to compress the exhaust gas. Problematically however, these cooling systems consume a significant amount of energy due to pumps and/or other energy consuming devices needed to circulate coolants through the cooling system.

Further, the exhaust gas of an internal combustion engine contains a significant amounts of water vapor. The water vapor has a relatively high specific volume and mass, which causes an unwanted burden on the compression work of the turbo compressor. Problematically, removing the water from a flow of exhaust gas using current techniques often requires a significant amount of energy.

Accordingly, there is a need for a system and method of cooling and drying a hydrated fluid without utilizing an undue amount of energy. There is a need for cooling and drying air in an air conditioning system with as little energy as possible. Further, there is also a need for cooling and drying exhaust gas from an internal combustion engine with as little energy as possible.

BRIEF DESCRIPTION

The present disclosure offers advantages and alternatives over the prior art by providing an absorption chiller system, which has an evaporator section that includes a transport membrane heat exchanger. The transport membrane heat exchanger may include a plurality of ceramic membrane tubes through, or around, which a refrigerant of the absorption chiller system flows under vacuum pressures that are low enough to vaporize the refrigerant within the first flow path. The ceramic membrane tubes advantageously transfer both heat energy and water from the hydrated fluid to the refrigerant to both cool and dry the fluid.

An absorption chiller system in accordance with one or more aspects of the present disclosure include a generator section, a condenser section, an evaporator section and an absorber section all in fluid communication with each other and which operate to circulate a refrigerant therethrough. The evaporator section includes a transport membrane heat exchanger. The transport membrane heat exchanger includes a first and a second flow path. The first flow path is operable to flow the refrigerant therethrough under a vacuum pressure that is low enough to vaporize the refrigerant within the first flow path. The second flow path is operable to pass a fluid having water (a hydrated fluid) therethrough. Both water and heat are transferred from the fluid in the second flow path to the refrigerant in the first flow path through a membrane-based material of the transport membrane heat exchanger, such that the fluid passing through the second flow path has at least a portion of its water removed and is cooled.

In some examples of the present disclosure, the membrane-based material of the transport membrane heat exchanger include a plurality of ceramic membrane tubes. Each tube of the plurality of tubes include an outside diameter, an inside diameter and a porous ceramic tube wall therebetween. The inside diameter of each tube defines a tube passageway therethrough. The first flow path extends around the outside diameter of each tube. The second flow path extends through the tube passageway of each tube. Both water and heat from the fluid passing through the second flow path migrates through the tube walls of each tube to the refrigerant in the first flow path.

In some examples of the present disclosure, the fluid in the second flow path includes a flow of air.

In some examples of the present disclosure, the fluid in the second flow path includes a flow of exhaust gas from an internal combustion engine.

In some examples of the present disclosure, the second flow path is operable to flow the exhaust gas therethrough under a vacuum pressure, the vacuum pressure in the second flow path being greater than the vacuum pressure in the first flow path.

In some examples of the present disclosure, the generator section includes an exhaust gas to generator section heat exchanger operable to receive the flow exhaust gas prior to the exhaust gas entering the second flow path of the transport membrane heat exchanger of the evaporator section. The exhaust gas to generator section heat exchanger operates to evaporate the refrigerant in the generator section to remove heat from the exhaust gas.

In some examples of the present disclosure, the generator section includes an engine coolant to generator section heat exchanger operable to receive a flow of engine coolant fluid that flows from the internal combustion engine. The engine coolant to generator section heat exchanger operates to evaporate the refrigerant in the generator section to remove heat from the engine coolant fluid.

In some examples of the present disclosure, the refrigerant is water.

In some examples of the present disclosure, the water transferred from the fluid in the second flow path mixes with the water functioning as a refrigerant in the first flow path to form a total flow of water.

In some examples of the present disclosure, a portion of the total flow of water in the first flow path flows as a flow of evaporated water to the absorber section. Additionally, a portion of the total flow of water in the first flow path flows a flow of condensed water out of the evaporator section.

In some examples of the present disclosure, a portion of the flow of condensed water out of the evaporator section is pumped into the absorber section.

A method of removing water from a fluid in accordance with one or more aspects of the present disclosure includes flowing a refrigerant under a vacuum pressure through a first flow path of a transport membrane heat exchanger of an evaporator section of an absorption chiller system. The refrigerant is vaporized within the first flow path. A fluid containing water is flowed through a second flow path of the transport membrane heat exchanger. Heat and water are transferred from the second flow path to the first flow path through a membrane-based material of the transport membrane heat exchanger, such that the fluid passing through the second flow path has at least a portion of its water removed and is cooled.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DRAWINGS

The disclosure will be more fully understood from the following detailed description taken in conjunction with the accompanying drawings, in which.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example may be combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 1:
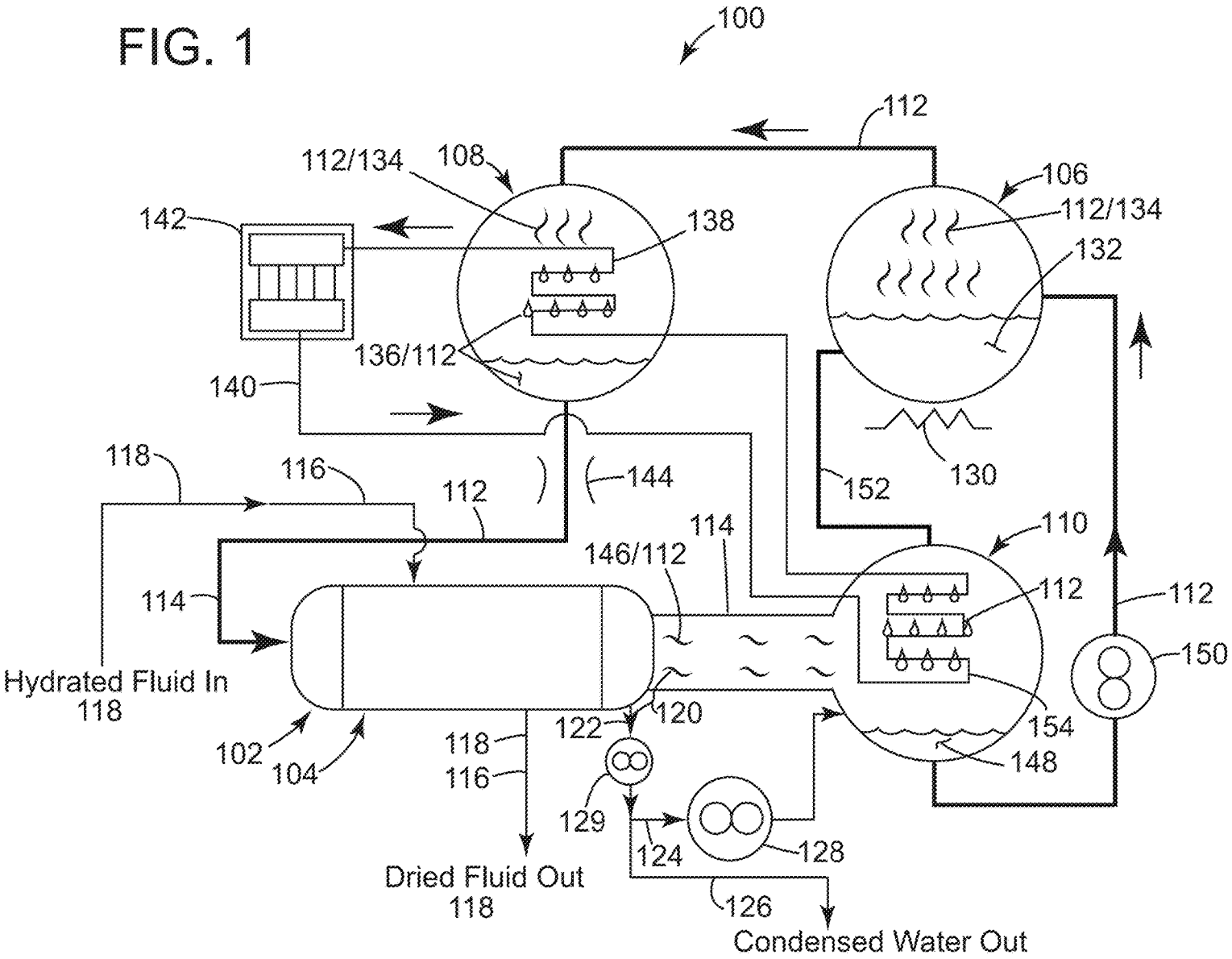
FIG. 1 depicts an example of an absorption chiller system having an evaporator section that includes a transport membrane heat exchanger, according to aspects described herein.

Referring to FIG. 1, an example is depicted of an absorption chiller system 100 having an evaporator section 102 that includes a transport membrane heat exchanger 104, according to aspects described herein. More specifically, the absorption chiller system 100 includes a generator section 106, a condenser section 108, the evaporator section 102 and an absorption section 110 all in fluid communication with each other and which operate to circulate a refrigerant 112 therethrough. In this case, the refrigerant 112 includes primarily water 112. Accordingly, the water functioning as a refrigerant may be referred to herein as a: "refrigerant 112", "water 112", or "water/refrigerant 112."

The evaporator section 102 of the absorber chiller system 100 includes the transport membrane heat exchanger 104. The transport membrane heat exchanger 104 includes membrane-based material (such as, for example, ceramic membrane tubes (see FIG. 2)) through which both heat energy and mass (such as water) can flow.

Membrane-based materials and membrane-based devices (such as vapor permeation membranes, membrane condensers and transport membrane heat exchangers (sometimes known as transport membrane condensers)) can transport heat energy and selectively water molecules, so that they may be used as a tool to control the flow of heat and water across the membrane-based material. Accordingly, membrane-based materials can be utilized to cool and dry certain fluids, such as air or exhaust gas from an internal combustion engine.

The ceramic membrane-based material may, for example, be a porous fine ceramic material, which may be sintered from Alumina, Titania or Zirconia. The ceramic membrane-based material may be composed of a hydrophobic polymer membrane, which may have pore sizes within a variety of ranges. For example, the pore sizes may be within a range of: about 0.1 to 0.2 micrometers, 0.2 micrometers or less, 0.1 micrometers or less, 0.5 micrometers or less, 0.2 micrometers or less, 0.1 micrometers or less, or about 0.01 to 0.02 micrometers.

The membrane-based material may employ hydrophilic ceramic membranes with a high thermal conductivity to condense water vapors within the membrane pores 166. The membrane-based material may include a block copolymer or a sulfonated poly (ether ether ketone) (i.e., SPEEK).

Figure 2:
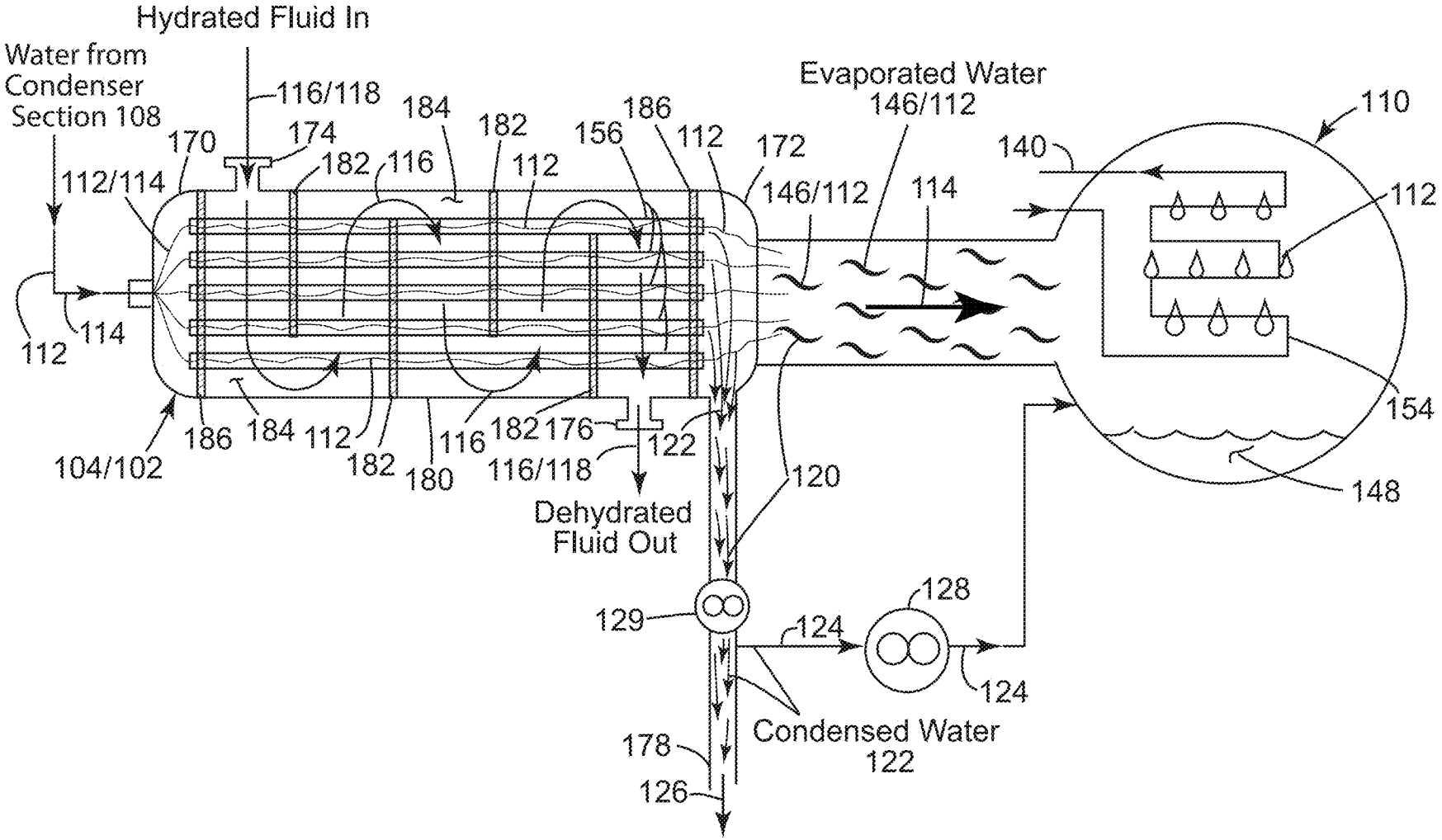
FIG. 2 depicts an example of a cross sectional view of the transport membrane heat exchanger of FIG. 1, according to aspects described herein.

The transport membrane heat exchanger 104 includes a first flow path 114 and a second flow path 116 (see FIG. 2). The first flow path 114 is operable to flow the refrigerant 112 (in this case water 112) therethrough under a vacuum pressure that is low enough to vaporize the refrigerant within the first flow path. As will be explained in greater detail herein, it is advantageous that at least the first flow path 114 of the transport membrane heat exchanger 104 be operable to flow the refrigerant 112 under vacuum pressures that induces evaporation of the refrigerant. One of the reasons this is advantageous is because this helps to maintain a large pressure differential across the membrane-based materials, which enhances the migration of water across the membrane. Another reason this is advantageous is because the heat energy of the fluid in the second flow path is readily absorbed by the refrigerant to overcome the latent heat of vaporization of the evaporating refrigerant, which enhances the heat transfer from fluid to refrigerant.

The second flow path 116 of the transport membrane heat exchanger 104 is operable to pass a fluid 118 having water 168 (see FIG. 4) therethrough. For example, the fluid 118 may be air or may be exhaust gas 216 from an internal combustion engine 202 (see FIG. 5).

Within the transport membrane heat exchanger 104, both water 168 and heat are transferred from the fluid 118 in the second flow path 116 to the refrigerant 112 in the first flow path 114 through the membrane-based material (such as ceramic membrane tubes 156 (see FIG. 2)) of the transport membrane heat exchanger 104. Accordingly, the fluid 118 passing through the second flow path 116 has at least a portion of its water 168 removed and the fluid 118 is cooled.

Figure 5:
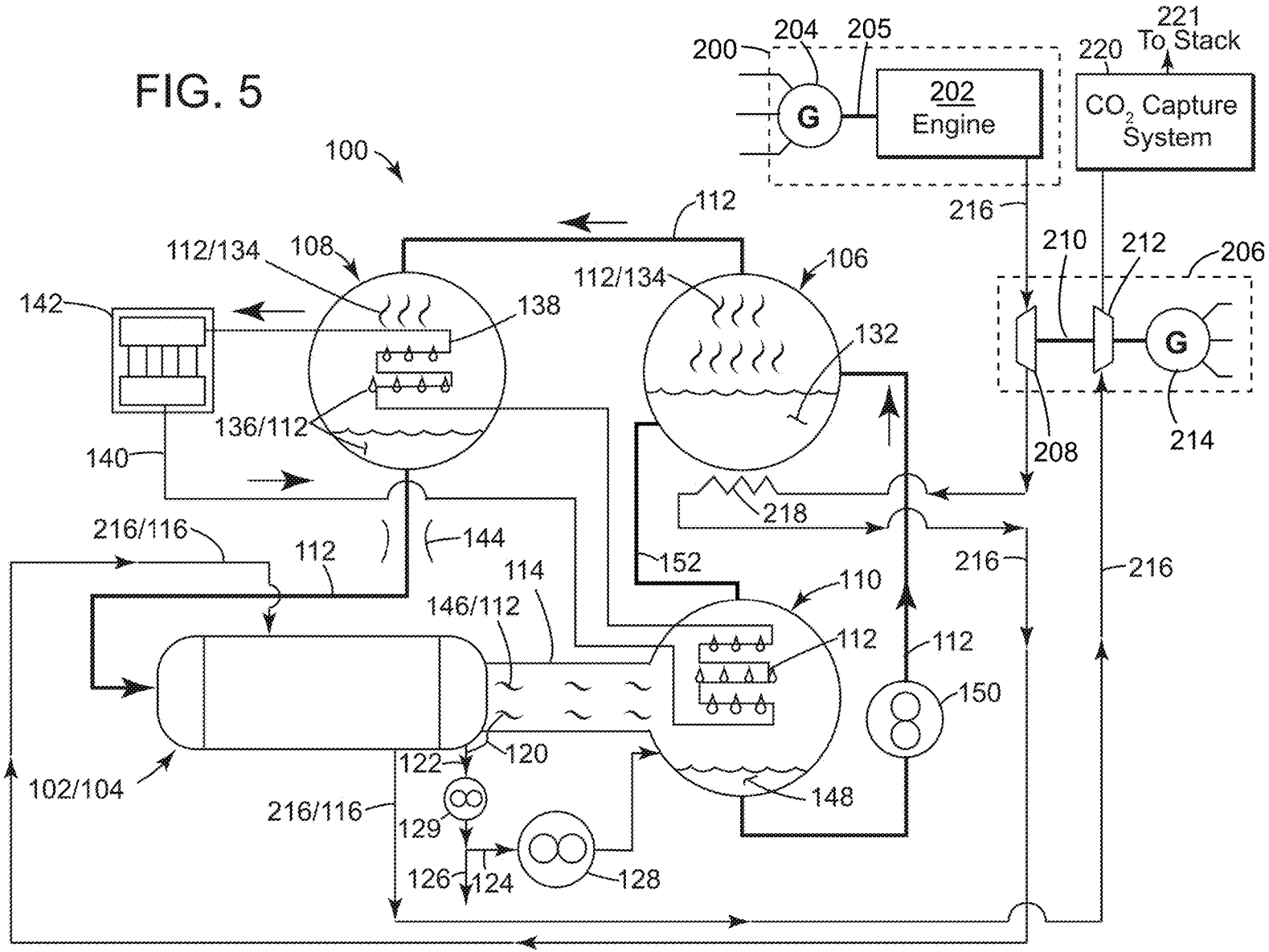
FIG. 5 depicts an example of a schematic view of the absorption chiller system of FIG. 1, wherein the fluid to be cooled and dried includes a flow of exhaust gas from an internal combustion engine, according to aspects described herein.
Figure 6:
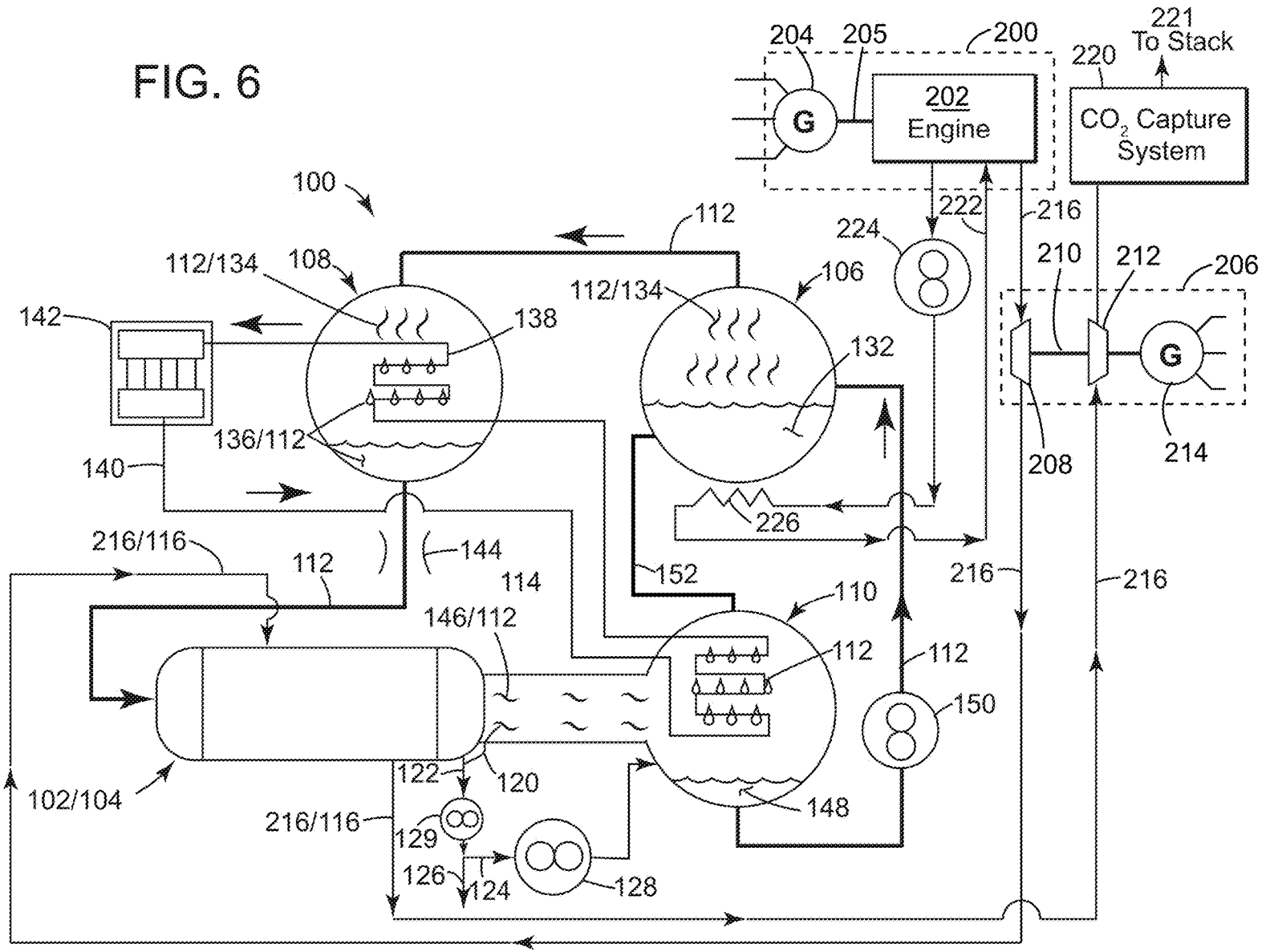
FIG. 6 depicts another example of a schematic view of the absorption chiller system of FIG. 1, wherein the fluid to be cooled and dried includes a flow of exhaust gas from an internal combustion engine, according to aspects described herein.

The flow of fluid 118 in the second flow path 116 may be water or may be a flow of exhaust gas 216 from an internal combustion engine 202 (see FIGS. 5 and 6). If the flow of fluid 118 is exhaust gas 216, then the second flow path 116 may be operable to flow the exhaust gas 216 therethrough under a vacuum pressure. However, advantageously, the vacuum pressure in the second flow path 116 may be at a greater pressure than the vacuum pressure in the first flow path 114. As such, the pressure differential is advantageously from the higher absolute pressure in the second flow path 116 (through which the hydrated fluid 118 flows) to the lower absolute pressure in the first flow path 114 (through which the refrigerant 112 flows). This pressure differential across the membrane-based material (such as ceramic membrane tubes 156 (see FIG. 2)) of the transport membrane heat exchanger 104 enhances the migration of water 168 in the fluid 116 to the refrigerant 112.

Within the transport membrane heat exchanger 104, the water 168 transferred from the fluid 118 in the second flow path 116 mixes with the water 112 functioning as a refrigerant 112 in the first flow path 114 to form a total flow of water 120 (see FIG. 2). The water functioning as a refrigerant 112 flows as a flow of evaporated water to the absorber section 110. Additionally, a portion of the total flow of water 120 may be pumped via pump 129 as a flow of condensed water 122 out of the evaporator section 102.

As will be explained in greater detail herein, the reason the condensed water 122 may be required to be pumped out of the evaporator section 102 via a pump 129 is because the first flow path 114 within the transport membrane heat exchanger 104, wherein the water 112 is functioning as a refrigerant, is under a vacuum low enough to evaporate water at temperatures between 40 and 50 degrees fahrenheit (F) For example, the first flow path 114 in the transport membrane heat exchanger 156 may be under a vacuum pressure of 0.12 psia. Therefore, a pump may be required to pump the condensed water 122 back up to atmospheric pressure of about 14.7 psia in order to exit the evaporator section 102.

The flow of condensed water 122 may additionally be split such that a portion 124 of the flow of condensed water 122 out of the evaporator section 102 may be diverted via valve or pump 128 back into the absorber section 110 as a flow of make-up water. The remaining flow of condensed water 126 may be pumped out of the absorption chiller system 100 and may be containerized to be sold, for example, as condensed water. The reasons a portion 124 of the condensed water 122 may be diverted back into the absorber section 110 is because the portion 124 of the condensed water 122 may be utilized as a flow of make-up water that is used to maintain the correct amount of refrigerant water 112 in the system 100.

The generator section 106 includes a heat source 130 that is operable to transfer heat into the generator section 106. The heat transferred into the generator section 106 boils a first solution 132 of the refrigerant 112 to produce a first flow of steam 134 in the generator section 106. The first solution 132 is generally a solution of salt and water or a solution of ammonia and water, although other refrigerant solutions that meet the thermodynamic requirements of the absorption chiller system 100 can also be used. In this specific embodiment, the first solution 132 is a brine solution of lithium bromide and water.

Once the first flow of steam 134 has evaporated out of the first solution 132, it flows into the condenser section 108 of the absorption chiller system 100. The condenser section 108 and generator section 106 are almost always located above the evaporator section 102 and absorber section 110 of the absorption chiller system 100. The condenser section 108 and generator section 106 are also maintained at approximately the same pressure, which is a higher pressure than the evaporator section 102 and absorber section 110. For example, the generator and condenser sections 106, 108 are often maintained within a range of about atmospheric pressure (i.e., 14.7 pounds per square inch absolute (psia)) to a vacuum pressure of about 4.9 psia. Whereas the evaporator and absorber sections 102, 110 are often maintained at a pressure of about 0.12 psia or lower.

Advantageously, the pressure within the first flow path 114 of the transport membrane heat exchanger 104 will also be at, or about, the same very low vacuum pressures of the evaporator section. For example, the pressures within the first flow path may be at a pressure of about 5 psia or less, 4 psia or less, 3 psia or less, 2 psia or less, 1 psia or less, 0.2 psia or less, 0.12 psia or less or 0.1 psia or less.

Also advantageously, the pressures within the first flow path may be at under a vacuum pressure that is low enough to vaporize the refrigerant within the first flow path, which greatly enhances the transfer of heat energy from the fluid 118 to the refrigerant 112 without raising the temperature of the refrigerant. For example, at a vacuum pressure of 0.12 psia or less in the first flow path 114, if water were the refrigerant 112, then the water 112 would evaporate at about 40 degrees fahrenheit (F). This would provide an extremely effective cooling effect, since the latent heat of vaporization of water is larger than almost any other commercially available refrigerant, i.e., about 40.65 kilojoules per mole, or about 2230 joules per gram or about 533 calories per gram of water. Accordingly, a great deal of heat energy from the fluid 118 (e.g., air or exhaust gas) would be absorbed by the vaporizing water/refrigerant 112 without raising the temperature of the water.

The condenser section 108 is operable to remove heat from the first flow of steam 134 and condense the steam into a flow of liquid water 136. More specifically in this embodiment, the condenser section 134 includes a set of condenser cooling coils 138 that are in fluid communication with chilled water 140 from a cooling tower 142. The cold condenser cooling coils 138 condense the steam 134 into the liquid water 136, which collects at the bottom of the condenser section 108.

Though a cooling tower 142 is used in this embodiment to cool at least the condensing coils 138 in the condenser section 108, it is within the scope of the present disclosure to use other types of cooling systems as well. For example, a variety of well-known stationary heat exchanger systems or vapor-compression refrigeration systems may be used to remove the heat from at least the cooling coils 138.

The liquid water 136 flows from the condenser section 108 through an orifice 144 (or other types of a variety of well-known pressure regulating devices) and into the first flow path 144 of the transport membrane heat exchanger 104 of the evaporator section 102. The orifice 144 provides and maintains a pressure differential between a first pressure of the condenser section 108 and a second lower pressure of the evaporator section 102. More specifically for this embodiment, the condenser section 108 may be at a vacuum pressure of about 4.9 psia where water boils at about 158 degrees F. and the evaporator section 102 may be at a much deeper vacuum pressure of about 0.12 psia where water boils at about 40 degrees F.

The pressure difference between the condenser section 108 and evaporator section 102 flash cools the liquid water 136/112 as it enters the first path 114 of the transport membrane heat exchanger 104. The water functioning as the refrigerant 112 then removes heat from the higher temperature fluid 118, which is passing through the second path 118 of the transport membrane heat exchanger 104.

Accordingly, the flow of liquid water/refrigerant 112 from the condenser section 108 is evaporated in the first flow path 114 of the lower pressure transport membrane heat exchanger 104 of the evaporator section 102 to produce a second flow of steam 146, which flows from the evaporator section 102 to the absorber section 110.

The absorber section 110 is in fluid communication with the second flow of steam 146 from the evaporator section 102. Additionally, the absorber section 110 contains a second solution 148 of refrigerant 112. The second solution 148 of refrigerant 112 has the same molecular composition as the first solution 132, but has a different percentage of water 112.

The lithium bromide (or salt) in the second solution 148 has a strong chemical attraction for the second flow of steam 146 as the water and salt naturally tend to combine in the absorber section 110. The attraction is so great, that it helps to maintain the near total vacuum pressures of, for example, about 0.12 psia or less in the evaporator and absorber sections 102, 110.

Advantageously, the strong chemical attraction for the second flow path enables the near total vacuum pressures in the evaporator 102, and therefore in the first flow path 114 of the transport membrane heat exchanger 104, without the use of any external vacuum pumps. This is advantageous because vacuum pumps consume a lot of electrical energy when running.

A solution pump 150 is in fluid communication with the first solution 132 and the second solution 148 of refrigerant 112. The solution pump 150 is operable to pump the second solution 148 in the absorber section 110 to the first solution 132 in the generator section 106.

Additionally in this embodiment, the first solution 132 is gravity fed through tubing 152 back down to the absorber section 110, where it is spayed on absorber cooling coils 154 that are disposed within the absorber section 110. The absorber cooling coils 154 are also cooled, in this embodiment, by chilled water 140 from the cooling tower 142 and are used to condense the second flow of steam 146 back into liquid water 112 which readily combines with the second solution 148 to complete a cooling cycle of the absorption chiller system 100.

Figure 3:
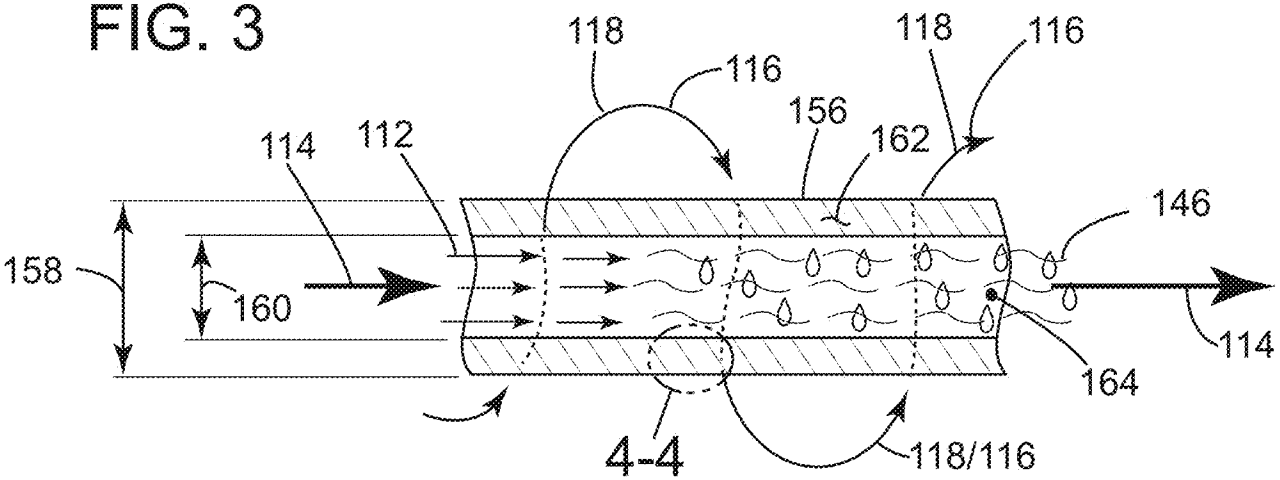
FIG. 3 depicts an example of a cross sectional view of a ceramic membrane tube of the transport membrane heat exchanger, according to aspects described herein.

Referring to FIGS. 2 and 3, an example is depicted of a cross sectional view of the transport membrane heat exchanger 104 (FIG. 2) and a cross sectional view of a ceramic membrane tube 156 (FIG. 3) of the transport membrane heat exchanger 104, according to aspects described herein. The membrane-based material of the transport membrane heat exchanger 104 includes a plurality of ceramic membrane tubes 156, each tube 156 of the plurality of tubes 156 includes an outside diameter 158, an inside diameter 160 and a porous ceramic tube wall 162 therebetween. The inside diameter 160 of each ceramic tube 156 defines a tube passageway 164 therethrough. The first flow path 114 (through which the refrigerant 112 flows) extends through a refrigerant entrance manifold 170 of the transport membrane heat exchanger 104 and into the tube passageway 164 of each tube 156. The first flow path 114 then extends from the tube passageway 164 of each tube 156 of the plurality of tubes 156 through a refrigerant exit manifold 172 of the transport membrane heat exchanger 104 to exit the expander section 102 and flow into the absorber section 110.

The second flow path 116 (through which the hydrated fluid 118 flows) extends through a fluid input port 174 of a heat exchanger outer shell 180 of the transport membrane heat exchanger 104. The heat exchanger outer shell 180 provides a hollow interior 184, which encloses the plurality of ceramic tubes 156. The heat exchanger outer shell is operable to withstand total vacuum pressures (e.g., up to 14.7 psia and more) without being damaged.

Once the hydrated fluid 118 flows through the fluid input port 174, it follows the second flow path 116, which extends around the outside diameter 158 of each ceramic membrane tube 156. Additionally, the second flow path 116 is directed laterally back and forth by a series of baffles 182 in a sinuous path as the second flow path 116 travels longitudinally along the hollow interior 184 toward an output port 176 of the transport membrane heat exchanger 104. The hollow interior 184 of the transport membrane heat exchanger 102 is sealed off from the refrigerant entrance manifold 170 and refrigerant exit manifold 172 by a pair of interior end walls 186, which are positioned on opposing longitudinal ends of the heat exchanger outer shell 180. The distal ends of each ceramic membrane tube 156 extend through each interior end wall 186 to enable the refrigerant 112 to enter and exit the tube passageways 164 without mixing with the fluid 118 following the second flow path 116 in the hollow interior 184 of the shell 180 of the transport membrane heat exchanger 104.

The second flow path 116 then extends through the output port 176 of the transport membrane heat exchanger 104 to exit the expander section 102. The fluid 118 which exits the output port 176 is now significantly cooled and dried of any moisture. This is because, both water 168 and heat from the fluid 118 passing through the second flow path 116 migrates through the tube walls 162 of each tube 156 to the refrigerant 112 in the first flow path 114.

The first flow path 114 extends through the tube passageway 164 of each ceramic membrane tube 156. Therefore, the ceramic membrane tubes 156 are operable to flow the refrigerant 112 (in this case water 112) therethrough under a vacuum pressure that is low enough to vaporize the refrigerant 112 within the tube passageways 164. For example, the pressures within the tube passageways 164 may be at a pressure of about 5 psia or less, 4 psia or less, 3 psia or less, 2 psia or less, 1 psia or less, 0.2 psia or less, 0.12 psia or less or 0.1 psia or less.

Accordingly, the water/refrigerant 112 in each of the tube passageways 164 will be vaporized due to the low vacuum pressures. It is advantageous to vaporize the refrigerant 112 within the tube passageways 164 because this helps to maintain a large pressure differential across the membrane-based tube walls 162, which enhances the migration of water 168 (see FIG. 4) across the membrane walls 162. Additionally, it is advantageous to vaporize the refrigerant 112 within the tube passageways 164 because the heat energy of the fluid 118 in the second flow path 116 is readily absorbed by the refrigerant 112 to overcome the latent heat of vaporization of the evaporating refrigerant 112, which greatly enhances the heat transfer from fluid 116 to refrigerant 112.

For example, at a vacuum pressure of 0.12 psia or less in the tube passageways 164, if water were the refrigerant 112, then the water 112 would evaporate at about 40 degrees fahrenheit (F). This would provide an extremely effective cooling effect, since the latent heat of vaporization of water is larger than almost any other commercially available refrigerant, i.e., about 40.65 kilojoules per mole, or about 2230 joules per gram or about 533 calories per gram of water. Accordingly, a great deal of heat energy from the fluid 118 (e.g., air or exhaust gas) would be absorbed by the vaporizing water/refrigerant 112 without raising the temperature of the water. Additionally, a positive pressure differential from fluid 118 in the first flow path 118 to the water 112 in the second flow path 114 would be maintained in about a range of 10 to 15 pounds per square inch (psi), which would greatly enhance the migration of water 168 across the tube walls 162.

Also advantageously, the salt (such as lithium bromide) in the second solution 148 of the absorber section 110 would provide a strong chemical attraction for the second flow of steam 146 (see FIG. 1) as the water and salt naturally tend to combine in the absorber section 110. The attraction is so great, that it would enable the maintain of the near total vacuum pressures (for example, about 0.12 psia or less) in the evaporator and absorber sections 102, 110 without the use of a vacuum pump. This is advantageous because vacuum pumps consume a lot of electrical energy when running and further because a vacuum pump would expel the refrigerant 112 to the atmosphere.

As the water 168 in the exhaust gas 216 migrates across the ceramic membrane tube walls 162, a substantial portion of the water 162 may remain condensed as condensed water 122. This is because, the evaporated refrigerant water 112 is operating at saturation conditions, when the migrating water 168 enters the tube passageway 164 of the ceramic membrane tubes 156. The condensed water 122 plus the evaporated water 112 flowing through the tube passageways 164 forms the total flow of water 120 flowing out of the transport membrane heat exchanger 104.

The condensed water 122 may be pumped via a pump 129 out of the evaporator section 102 through a condensed water port 178 to be used for other purposes. In other words, a portion of the total flow of water 120 in the first flow path 114 may flow as a flow of evaporated water 112 to the absorber section 110, while a portion of the total flow of water 120 in the first flow path 114 may flow as a flow of condensed water 122 out of the evaporator section 102.

Additionally, a portion 124 of the flow of condensed water 122 out of the evaporator section 102 may be diverted back into the absorber section 110 via water valve 128. Advantageously, the portion 124 pumped back into the absorber section 110 provides a flow of make-up water that can be used to regulate the total amount of refrigerant water 112 circulating through the absorption chiller system 100. The remainder of the condensed water 126 that is not used as make-up water may be flowed out of the evaporator 102 to be used for other purposes. Examples of such other purposes may be using the condensed water 126 for agricultural purposes or mixing the condensed water with additive to make diesel exhaust fluid (DEF).

Figure 4:
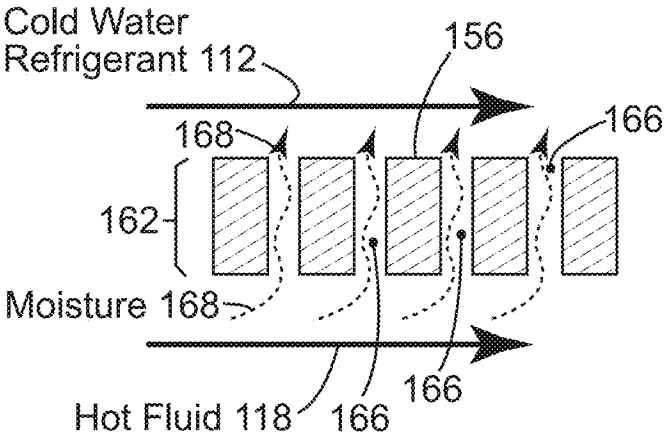
FIG. 4 depicts an example of an enlarged view of the circular area 4-4 of FIG. 3, according to aspects described herein.

Referring to FIG. 4, an example is depicted of an enlarged view of the circular area 4-4 of FIG. 3, according to aspects described herein. The enlarged view is a cross sectional view of the tube wall 162 of the ceramic membrane tubes 156.

The tube wall 162 is composed of a membrane-based material having a plurality of pores 166. In this case, the tube walls 162 are composed of a ceramic membrane based material. The ceramic membrane-based material may, for example, be a porous fine ceramic material, which may be sintered from Alumina, Titania or Zirconia. The ceramic membrane-based material may be composed of a hydrophobic polymer membrane, which may have pores 166 that have sizes within a variety of ranges. For example, the sizes of the pores 166 may be within a range of: about 0.1 to 0.2 micrometers, 0.2 micrometers or less, 0.1 micrometers or less, 0.5 micrometers or less, 0.2 micrometers or less, 0.1 micrometers or less, or about 0.01 to 0.02 micrometers.

The membrane-based material may employ hydrophilic ceramic membranes with a high thermal conductivity to condense water vapors within the membrane pores. The membrane-based material may include a block copolymer or a sulfonated poly (ether ether ketone) (i.e., SPEEK).

Referring to FIG. 5, an example is depicted of a schematic view of the absorption chiller system 100 of FIG. 1, wherein the fluid 118 includes a flow of exhaust gas 216 from an internal combustion engine 202 of a primary power supply 200, according to aspects described herein. The primary power supply 200 includes the engine 202 having a crankshaft 205, which is connected to a primary generator 204.

The exhaust gas 216 flows from the engine 202 and may enter a turbine-generator system 206. The turbine generator system 206 may advantageously be utilized to supply electrical power to the absorption chiller system 100. The turbine-generator system 206 is a form of bottoming cycle power system, that can be used to supply a portion of, or all, electrical power requirements of the absorption chiller system 100. Such bottoming system power systems are described in patent application Ser. No. 17/448,943, filed on Sep. 27, 2021, titled: SYSTEMS AND METHODS ASSOCIATED WITH BOTTOMING CYCLE POWER SYSTEMS FOR GENERATING POWER AND CAPTURING CARBON DIOXIDE, and in issued U.S. Pat. No. 11,346,256, filed on Sep. 27, 2021, titled: SYSTEMS AND METHODS ASSOCIATED WITH BOTTOMING CYCLE POWER SYSTEMS FOR GENERATING POWER, CAPTURING CARBON DIOXIDE AND PRODUCING PRODUCTS, both of which are incorporated herein by reference in their entirety.

The turbine-generator system 206 includes a turbo-expander 208 and turbo-compressor 212 disposed on a turbo-crankshaft 210. The turbo-expander 208 operates to rotate the turbo-crankshaft 210 as the flow of exhaust gas 216 from the engine 202 passes through the turbo-expander 208. The turbo-compressor 212 operates to compress the flow of exhaust gas 216 after the exhaust gas 216 passes through the turbo-expander 208. A bottoming cycle generator 214 may be disposed on the turbo-crankshaft 210. The bottoming cycle generator 214 may be connected to the absorption chiller system 100. The bottoming cycle generator 214 may operate to provide at least a portion of electric power required to operate the absorption chiller system 100.

During operation, the exhaust gas 216 from the internal combustion engine 202 enters and expands in the turbo-expander 208. By way of example, the exhaust gas 216 could enter the turbo-expander 208 at about 700 to 900 degrees fahrenheit (F) and about 10 psi above atmospheric pressure. By doing so, the exhaust gas 216 does work by initiating rotation of the turbo-crankshaft 210 which rotates the turbo-compressor 212 and the bottoming cycle generator 214. Rotation of the turbo-compressor 212 results in a vacuum (for example, a vacuum in a range of about 4 to 10 psi below atmospheric pressure or about 10.7 to 4.7 pounds per square inch absolute (psia)) being pulled on the exhaust gas 216 as it passes through the turbo-expander 208. This vacuum pressure range advantageously increases the pressure differential across the turbo-expander 208 and, therefore, enhances the total power that can be generated by the bottoming cycle generator 214.

The exhaust gas 216 exits the turbo-expander 208 and then flows into an exhaust gas to generator section heat exchanger 218 of the generator section 106 of the absorption chiller system 100. The exhaust gas to generator section heat exchanger 218 is operable to receive the flow of exhaust gas 216 prior to the exhaust gas 216 entering the second flow path 116 of the transport membrane heat exchanger 104 of the evaporator section 102. The exhaust gas to generator section heat exchanger 218 functions as the heat source 130, as described with reference to FIG. 1. The heat removed from the exhaust gas 216 by the exhaust gas to generator section heat exchanger 218 boils the first solution 132 of refrigerant 112 to produce the first flow of steam 134 in the generator section 106, which initiates the previously discussed refrigeration cycle of the absorption chiller system 100.

From the exhaust gas to generator section heat exchanger 218, the exhaust gas 216 flows into the second flow path 116 of the transport membrane heat exchanger 104 of the expander section 102. More specifically in this example, the exhaust gas 216 enters the tube passageways 164 of the ceramic membrane tubes 156.

Advantageously, even though there is a substantial vacuum on the flow of exhaust gas 216 out of the turbo-expander 208 (which, in this example, is functioning as the hydrated fluid 118 in the second flow path 116 of the transport membrane heat exchanger 104), the absolute pressures on the exhaust gas 216 in the second flow path 116 are configured to be substantially greater than the absolute pressures on the refrigerant 112 evaporating in the first flow path 114 of the transport membrane heat exchanger 104 of the expander section 102. For example, the pressure on the exhaust gas 216 in the second flow path 116 may be configured to be about 10.6 to 4.6 psia greater than the pressure on the evaporating refrigerant/water 112 in the composite ceramic tubes 156 of the first flow path 114. This positive pressure across the walls 162 of the ceramic tubes 156 greatly enhances the migration of moisture 168 from exhaust gas 216 to refrigerant 112 in the expander section 102.

The exhaust gas 216 then exits the expander section 102 as cooled and dried exhaust gas 216. The exhaust gas then flows into the turbo-compressor 212 of the turbine generator system 206, where it is compressed back to atmospheric pressures or greater. From the turbo-compressor 212, the cooled and dried exhaust gas 216 may flow into a carbon dioxide capture system 220, which removes the carbon dioxide from the exhaust gas 216. Advantageously, the carbon dioxide capture system functions more efficiently with the water 168 removed from the exhaust gas 216 and with the exhaust gas 216 cooled. From the carbon dioxide capture system 220, the exhaust gas 216 may flow up a stack 221 associated with the internal combustion engine 202.

Referring to FIG. 6, another example is depicted of a schematic view of the absorption chiller system 100 of FIG. 1, wherein the fluid 118 includes a flow of exhaust gas 216 from an internal combustion engine 202 of a primary power supply 200, according to aspects described herein. The example illustrated in FIG. 6 is similar to the example illustrated in FIG. 5, except that engine coolant fluid 222 from the internal combustion engine 202, rather than the exhaust gas 216, is used as the heat source for the generator section 106.

More specifically, engine coolant fluid 222 from the engine 202 is pumped via engine coolant pump 224 to an engine coolant to generator section heat exchanger 226. The engine coolant to generator section heat exchanger 226 functions as the heat source 130, as described with reference to FIG. 1. The engine coolant to generator section heat exchanger 226 operates to evaporate the refrigerant 112 in the generator section to remove heat from the engine coolant fluid 222. The heat removed from the engine coolant 222 by the exhaust gas to generator section heat exchanger 226 boils the first solution 132 of refrigerant 112 to produce the first flow of steam 134 in the generator section 106, which initiates the previously discussed refrigeration cycle of the absorption chiller system 100.

The exhaust gas 216 flows from the engine 202 through the turbo-expander 208. From the turbo-expander 208, the exhaust gas 216 flows directly into the second flow path 116 of the transport membrane heat exchanger 104 of the expander section 102. More specifically in this example, the exhaust gas 216 enters the tube passageways 164 of the ceramic membrane tubes 156.

Advantageously, even though there is a substantial vacuum on the flow of exhaust gas 216 out of the turbo-expander 208 (which, in this example, is functioning as the hydrated fluid 118 in the second flow path 116 of the transport membrane heat exchanger 104), the absolute pressures on the exhaust gas 216 in the second flow path 116 are configured to be substantially greater than the absolute pressures on the refrigerant 112 evaporating in the first flow path 114 of the transport membrane heat exchanger 104 of the expander section 102. For example, the pressure on the exhaust gas 216 in the second flow path 116 may be configured to be about 10.6 to 4.6 psia greater than the pressure on the evaporating refrigerant/water 112 in the composite ceramic tubes 156 of the first flow path 114. This positive pressure across the walls 162 of the ceramic tubes 156 greatly enhances the migration of moisture 168 from exhaust gas 216 to refrigerant 112 in the expander section 102.

The exhaust gas 216 then exits the expander section 102 as cooled and dried exhaust gas 216. The exhaust gas then flows into the turbo-compressor 212 of the turbine generator system 206, where it is compressed back to atmospheric pressures or greater. From the turbo-compressor 212, the cooled and dried exhaust gas 216 may flow into a carbon dioxide capture system 220, which removes the carbon dioxide from the exhaust gas 216. Advantageously, the carbon dioxide capture system functions more efficiently with the water 168 removed from the exhaust gas 216 and with the exhaust gas 216 cooled. From the carbon dioxide capture system 220, the exhaust gas 216 may flow up a stack 221 associated with the internal combustion engine 202.

Figure 7:
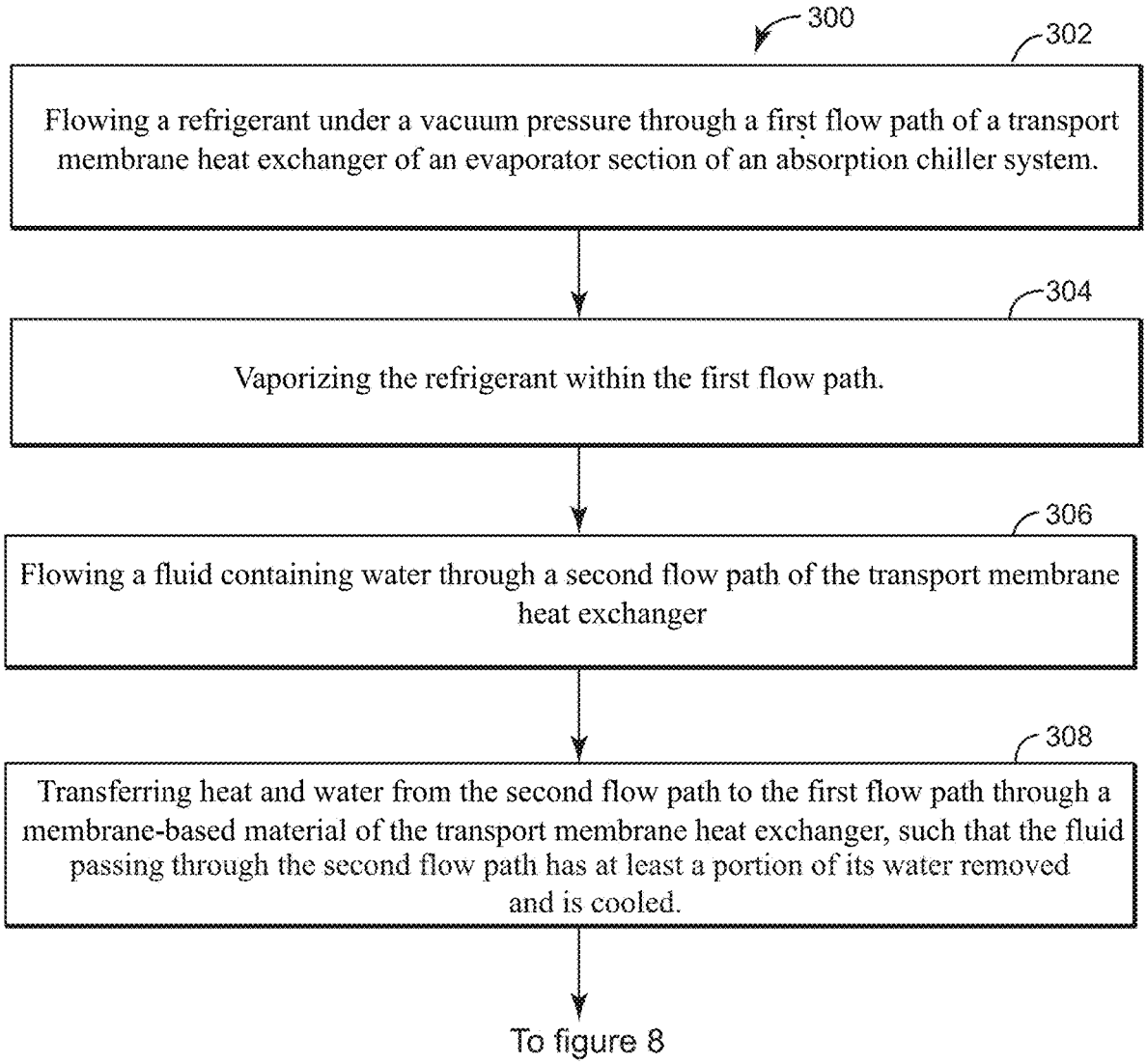
FIG. 7 depicts an example of a flow diagram of a method of removing water from a fluid, according to aspects described herein.

Referring to FIG. 7, an example is depicted of a flow diagram of a method 300 of removing water 168 from a fluid 118, according to aspects described herein.

The method 300 begins at 302, wherein a refrigerant 112 (such as water) under a vacuum pressure is flowed through a first flow path 114 of a transport membrane heat exchanger 104 of an evaporator section 102 of an absorption chiller system 100.

At 304, the refrigerant 112 is vaporized within the first flow path 114.

At 306, a fluid 118 containing water 168 is flowed through a second flow path 116 of the transport membrane heat exchanger 104.

At 308, heat and water 168 are transferred from the second flow path 116 to the first flow path 114 through a membrane-based material, such as ceramic membrane tubes 156, of the transport membrane heat exchanger 104, such that the fluid 118 passing through the second flow path 116 has at least a portion of its water 168 removed and is cooled.

Figure 8:
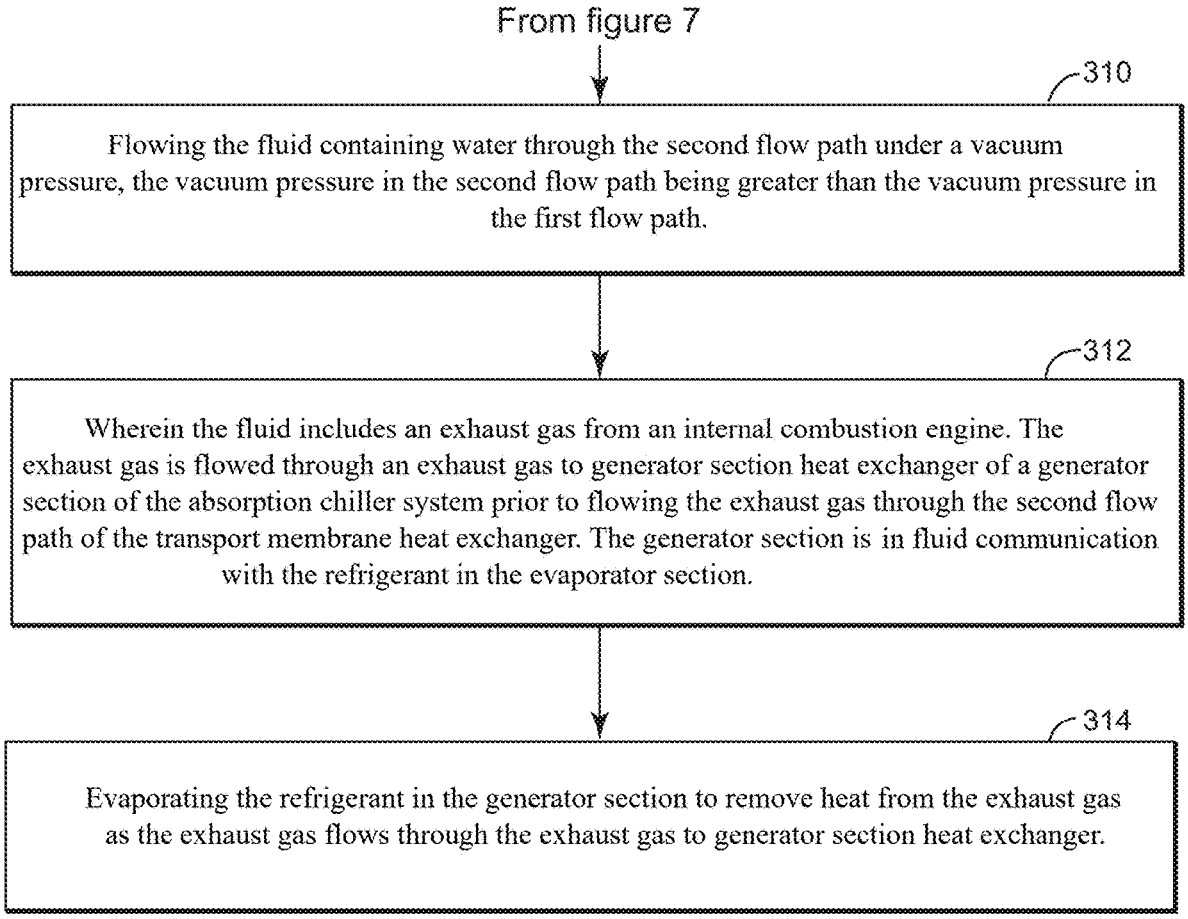
FIG. 8 depicts an example of a flow diagram of a continuation of the method of FIG. 7, according to aspects described herein.

Referring to FIG. 8, an example is depicted of a flow diagram of a continuation of the method 300, according to aspects described herein.

The method 300 continues at 310, wherein the fluid 118 containing water 168 is flowed through the second flow path 116 under a vacuum pressure. The vacuum pressure in the second flow path 116 is greater than the vacuum pressure in the first flow path 114.

At 312, the fluid 118 includes an exhaust gas 216 from an internal combustion engine 202. The exhaust gas 216 is flowed through an exhaust gas to generator section heat exchanger 218 of a generator section 106 of the absorption chiller system 100 prior to flowing the exhaust gas 216 through the second flow path 116 of the transport membrane heat exchanger 104. The generator section 106 is in fluid communication with the refrigerant 112 in the evaporator section 102.

At 314, the refrigerant 112 in the generator section 106 is evaporated to remove heat from the exhaust gas 216 as the exhaust gas 216 flows through the exhaust gas to generator section heat exchanger 218.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. An absorption chiller system comprising:

a generator section, a condenser section, an evaporator section and an absorber section all in fluid communication with each other and which operate to circulate a refrigerant therethrough;

the evaporator section comprising a transport membrane heat exchanger comprising a first and a second flow path, the first flow path operable to flow the refrigerant therethrough under a vacuum pressure that is low enough to vaporize the refrigerant within the first flow path, the second flow path operable to pass a fluid having water therethrough;

wherein the fluid in the second flow path comprises a flow of exhaust gas from an internal combustion engine, the second flow path operable to flow the exhaust gas therethrough under a vacuum pressure, the vacuum pressure in the second flow path being greater than the vacuum pressure in the first flow path; and wherein both water and heat are transferred from the fluid in the second flow path to the refrigerant in the first flow path through a membrane-based material of the transport membrane heat exchanger, such that the fluid passing through the second flow path has at least a portion of the water included in the fluid having water is removed and is cooled;

wherein the refrigerant comprises water;

wherein the water transferred from the fluid in the second flow path mixes with the water functioning as a refrigerant in the first flow path to form a total flow of water;

wherein:

a portion of the total flow of water in the first flow path flows as a flow of evaporated water to the absorber section, and a portion of the total flow of water in the first flow path flows a flow of condensed water out of the evaporator section; and wherein:

a portion of the flow of condensed water out of the evaporator section is pumped into the absorber section.

2. The absorption chiller system of claim 1, comprising:

the membrane-based material of the transport membrane heat exchanger comprising a plurality of ceramic membrane tubes, each tube of the plurality of tubes comprising an outside diameter, an inside diameter and a porous ceramic tube wall therebetween, the inside diameter of each tube defining a tube passageway therethrough;

the first flow path extending through the tube passageway of each tube;

the second flow path extending around the outside diameter of each tube; and wherein, both water and heat from the fluid passing through the second flow path migrates through the tube walls of each tube to the refrigerant in the first flow path.

3. The absorption chiller system of claim 1, comprising:

the generator section including an exhaust gas to generator section heat exchanger operable to receive the flow exhaust gas prior to the exhaust gas entering the second flow path of the transport membrane heat exchanger of the evaporator section; and wherein, the exhaust gas to generator section heat exchanger operates to evaporate the refrigerant in the generator section to remove heat from the exhaust gas.

4. The absorption chiller system of claim 1, comprising:

the generator section including an engine coolant to generator section heat exchanger operable to receive a flow of engine coolant fluid from the internal combustion engine, the engine coolant to generator section heat exchanger operates to evaporate the refrigerant in the generator section to remove heat from the engine coolant fluid.

5. The absorption chiller system of claim 1, wherein the first flow path is operable to flow the refrigerant therethrough under a vacuum pressure that is 1.0 psia or less.

6. The absorption chiller system of claim 5, wherein the first flow path is operable to flow the refrigerant therethrough under a vacuum pressure that is 0.2 psia or less.

7. The absorption chiller system of claim 1, wherein the vacuum pressure in the second flow path is greater than the vacuum pressure in the first flow path by about 4.6 psi or greater.

8. The absorption chiller system of claim 1, wherein the vacuum pressure in the first flow path is maintained by an attraction of the flow of refrigerant to a salt in a solution of the refrigerant in the absorber section.

9. The absorption chiller system of claim 8, wherein the vacuum pressure in the first flow path is maintained without the use of a vacuum pump.

* * * * *